US006363954B2

(12) United States Patent
Bastien

(10) Patent No.: US 6,363,954 B2
(45) Date of Patent: Apr. 2, 2002

(54) PAINT ROLLER CLEANING DEVICE

(76) Inventor: Alex Bastien, 175, Beauharnois, Sherbrooke, Quebec (CA), J1G 3Z2

( * ) Notice: Subject to any disclaimer, the term of this patent is extended or adjusted under 35 U.S.C. 154(b) by 0 days.

(21) Appl. No.: 09/860,532

(22) Filed: May 21, 2001

(30) Foreign Application Priority Data

May 23, 2000 (GB) ..... 0012316

(51) Int. Cl.[7] ..... B08B 3/02
(52) U.S. Cl. ..... 134/141; 134/149; 134/900
(58) Field of Search ..... 134/141, 153, 134/157, 149, 900

(56) References Cited

U.S. PATENT DOCUMENTS

| | | | | |
|---|---|---|---|---|
| 2,831,488 | A | * | 4/1958 | Anderson |
| 2,938,368 | A | * | 5/1960 | Bixel |
| 3,037,516 | A | * | 6/1962 | Leach |
| 3,075,534 | A | * | 1/1963 | Habostad |
| 3,126,899 | A | * | 3/1964 | Caywood |
| 3,422,828 | A | * | 1/1969 | Dommer |
| 3,428,060 | A | * | 2/1969 | Spivey |
| 3,873,364 | A | * | 3/1975 | Smith |
| 4,130,134 | A | * | 12/1978 | Sherwin |
| 4,294,272 | A | * | 10/1981 | Klaiber |
| 4,311,158 | A | * | 1/1982 | Harvey |
| 4,735,221 | A | * | 4/1988 | Vegiard |
| 5,626,158 | A | * | 5/1997 | Gratopp |
| 5,651,381 | A | * | 7/1997 | Balouchain |
| 5,816,275 | A | * | 10/1998 | Mullen |

FOREIGN PATENT DOCUMENTS

| | | | |
|---|---|---|---|
| DE | 2949554 | * | 6/1981 |
| GB | 2072001 | * | 9/1981 |
| GB | 2219732 | * | 12/1989 |

* cited by examiner

*Primary Examiner*—Frankie L. Stinson

(57) ABSTRACT

A cleaning device for cleaning a paint roller cover with a cleaning liquid emanating from a liquid pressure supply line. The cleaning device includes a generally elongated casing for receiving the paint roller cover. The casing is provided with a casing slot extending through the casing peripheral. A roller cover support assembly is mounted within the casing for rotatably supporting the paint roller. A liquid discharge assembly is attached to the casing for discharging the cleaning liquid into the casing along a path lying on a chord either of the paint roller cover of a turbine component mounted on a spindle shaft. Support structure is attached to the casing for supporting the latter on a supporting surface in a generally horizontal orientation. The casing support structure allows the casing to be supported on the horizontal surface in both a first and a second supporting configuration wherein when the casing is supported in the first supporting configuration the casing slot is positioned underneath the paint roller cover while when the casing is supported in the second supporting configuration, the casing slot is positioned in a geometrical plane intersecting the paint roller cover. In the first supporting configuration the liquid is allowed to drain out of the casing through the casing slot before it accumulates to the point of reaching the paint roller cover while when the casing is in the second supporting configuration the cleaning liquid is allowed to accumulate in the peripheral wall-to-roller cover spacing thus allowing at least a portion of the nap to soak in the accumulated volume of cleaning liquid.

20 Claims, 3 Drawing Sheets

PAINT ROLLER CLEANING DEVICE

FIELD OF THE INVENTION

The present invention relates to the general field of painting accessories and is particularly concerned with a paint roller cleaning device.

BACKGROUND OF THE INVENTION

Paint roller assemblies are commonly used by both commercial painters and owners for fast and efficient painting of flat surfaces such as walls, ceilings and the like using various types of paints and other finishes. Typically, a paint roller assembly includes a handle attached to a rotatable cylinder or wire frame which slidably fits into and frictionally holds a removable roller cover. The paint roller assembly allows for rotation of the roller cover to pick up paint from a tray or container and to roll a thin layer of the paint over the surface being painted.

Conventional paint roller covers typically include an inner cylindrical tube made out of a suitable material such as cordwood or a suitable polymeric resin. The inner tube is typically covered with a nap made of a suitable material capable of absorbing and distributing paint and other finishes. Typically, the nap is made out of a tufted fiber, a carpet like fabric, a polymeric foam or any other type of covering that will hold and apply paint and other finishes relatively uniformly to a flat surface.

Typically, after use, the paint roller cover is either cleaned for reuse or discarded. Many paint roller covers, specially those with a heavy nap are expensive and therefore justify cleaning for reuse. Furthermore, increased environmental concerns have lead to a concurrent trend towards reuse of roller covers or at least cleaning thereof prior to their discarding.

The development of latex based paints has significantly lessened the amount of effort and work that is required to clean paint roller covers after painting so that they can be reused. Indeed, latex based paints, while in a wet state, are readily water soluble and, thus, paint roller covers can simply be cleaned with water. On the other hand, enamel based paints require that the paint roller covers be soaped in turpentine or similar solvents to remove the paint and then washed with preferably soap and water to remove the turpentine or other solvent.

Whether latex or enamel based paints are used, cleaning of paint roller covers require a significant effort if all of the paint is to be removed from the fiber forming the nap. Although the removal of most of the paint from the nap may prove to be difficult it is nevertheless important since any paint which remains in the nap fibers lessens the reusable life of the roller and reduces the efficacy of the paint roller cover even after only one use.

In the past, rollers have typically been cleaned in a bucket or a sink by simply emerging them in a suitable liquid and vigorously rubbing the fibers by hand to ensure that all of the paint was loosened and removed. This method while being one of the simplest is also one of the messiest and most time consuming. Indeed, the person cleaning the paint roller cover inevitably gets paints onto its hand or arm which must be in time washed off. Also, the sink or bucket becomes coated with paint, and, thus, must be cleaned and rinsed after the paint roller cover is cleaned. Furthermore, the process must be repeated several times in order to obtain a clean roller cover.

Another method which has often be used involves simply squirting the paint roller cover with a stream of water from a garden hose whether the paint roller cover has been soaped or not previously in a suitable solvent depending on wether enamel or latex based paints were used. However, when washing a paint roller with a garden hose it is difficult to control the force of the spray and also the angle at which it impinges the paint roller cover. Also there is no way that the paint roller cover elements can be vigorously robbed so as to loosen and remove the paint without first putting the hose down. Again, this method although simple is both inconvenient in time consuming.

In an attempt to circumvent the herein above mentioned problems, several devices have been proposed to clean paint roller covers. These devices usually include cylindrical containers which enclose the paint roller cover, together with some type of spraying means for directing a stream of water against the paint roller cover. These prior art devices may eliminate, to some extent the problems associated with the other conventional methods. By directing a high pressure stream of water against the nap of the paint roller cover, the paint is generally loosened and removed more easily. However, these prior devices typically appear to be somewhat complicated and, in most instances, relatively expensive.

Other prior art attempts have been made to provide mechanical cleaners so that they may be used repeatingly for cleaning with a certain amount of success paint roller covers. The more sophisticated cleaners have used electric motors and water driven turbines to spin the roller while it is being cleaned. One common approach has been to direct a water spray substantially tangentially against the paint roller cover, causing into spin on the applicator handle or on a separate mandrel. None of the prior art cleaners which have been marketed have met with wide consumer acceptance thereby indicating the hidden or unobvious complexity of a seamingly simple device. The failings of the priorate attempts, as attested by the absence of any widely accepted cleaning device, have resulted from various inadequacies of the prior art devices which are either overly complex for useful operation or too simple to function properly.

Apart from being either overly complex or too simple most prior art paint roller cover cleaners suffer from at least three major drawbacks. First, most prior art cleaners simply do not allow for a dual mode of operation in which the intended user may choose either to soap at least a section of the nap prior to or after using the conventional tangential water spray technique. This proves to be a major drawback since, in some instances such as when thick nap or a viscous paint is used, it may prove to me highly desirable to be able to sequentially soak and spin clean the pain roller covers.

Also, most prior art paint roller cover cleaners do not allow for easy and ergonomical switch between a spin cleaning and a spin drying operation. In other words, although some prior art attempts have proposed the use of spin drying for drying the paint roller covers once they have cleaned, these prior art devices do not provide a structure which facilities the switch between spin cleaning and spin drying operations. Of course, devices offering both soaking and spin cleaning capability as well as readily accessible spin drying capability are even more difficult to find.

Third, both prior art devices simply do not provide a structure that facilitates the strategic positioning of the stream of spray of cleaning liquid so that it can be easily directed against the paint roller cover through a range of angles which optimizes cleaning and accommodates rollers of various diameters.

Accordingly, their existing a need for an improved device for cleaning paint roller covers. Advantages of the present invention include that the proposed paint roller cover cleaning device allows an intended user to selectively soak at least a portion of the paint roller cover nap or spin clean the nap using a generally tangential spray of cleaning liquid in a conventional fashion. Alternatively, the intended user may even use both the soaking and spin cleaning method not only sequentially but also simultaneously.

Also, the proposed paint roller cover cleaning device allows an intended user to quickly and ergonomically switch from a cleaning to a spin drying operation by nearly moving the spray nozzle along the casing of the cleaning device.

Furthermore, the proposed paint roller cover cleaning device allows for selective positioning of the cleaning spray nasal both longitudinally along the length of the paint roller cover and radially along the thickness of the nap so as to provide a means for having an optimally localized spray of cleaning liquid.

Still further, the proposed paint roller cleaning device is as specifically designed so as to be readily assembled and disassembled for facilitating the cleaning operation of the device itself. The proposed cleaning device is also designed so as to be manufacturable using conventional forms of manufacturing therefore providing a cleaning device that will be economically feasable, long lasting and relatively trouble free in operation.

The proposed cleaning device is also designed to as to be usable in a conventional household without requiring special tooling or manual of dexterity. The proposed cleaning device is designed so as to be used with the existing water hookups found in most residential and commercial establishments. It is designed so as to be capable of complete cleaning of the paint roller cover in a relatively short time and so as to be able to produce a clean roller cover which is sufficiently dry to be prevent any subsequent dripping or draining of water or other solvents.

SUMMARY OF THE INVENTION

In accordance with an embodiment of the present invention, there is provided a cleaning device for cleaning a paint roller cover with a cleaning liquid emanating from a liquid pressure supply line, the paint roller cover including a cylindrical roller tube covered with a nap, the paint roller cover defining a roller cover longitudinal axis, the cleaning device being adapted to be used on a generally horizontal supporting surface, the cleaning device comprising: a generally elongated casing for receiving the paint roller cover, the casing defining a casing longitudinal axis, a casing peripheral wall and a pair of opposed casing end walls, the casing being provided with a casing slot extending through the casing peripheral wall, the casing slot being oriented so as to extend in a direction substantially parallel to the casing longitudinal axis; a roller cover support means mounted within the casing for rotatably supporting the paint roller cover within the casing with the roller cover longitudinal axis extending in a generally parallel relationship relative to the casing longitudinal axis, the roller cover support means allowing the paint roller cover to rotate about the roller cover longitudinal axis relative to the casing peripheral wall; the casing being configured and sized so as to define a peripheral wall-to-roller cover spacing between the inner surface of the casing peripheral wall and the paint roller cover; liquid discharge means attached to the casing for discharging the cleaning liquid into the casing, the liquid discharge means including a nozzle tube extending from outside the casing into the casing, the nozzle tube defining a nozzle inlet end located outside the casing and adapted to be hydraulically coupled to the liquid pressure supply line, the nozzle tube also defining a nozzle outlet end positioned inside the casing and oriented so as to discharge a jet of the cleaning liquid along a path lying on a chord of the paint roller cover, the nozzle tube being slideably mounted to the casing so as to allow slidable movement of the nozzle outlet end in a direction generally parallel to the roller cover longitudinal axis; a casing support means attached to the casing for supporting the casing on the supporting surface with the casing longitudinal axis in a generally horizontal orientation, the casing support means allowing the casing to be supported on the horizontal surface in both a first and a second supporting configuration, wherein when the casing is supported in the first supporting configuration the casing slot is positioned in a slot first horizontal geometrical plane located underneath the paint roller cover in a proximal relationship relative to the support surface and wherein when the casing is supported in the second supporting configuration the casing slot is positioned in a slot second horizontal geometrical plane intersecting the paint roller cover; whereby when the casing is supported in the first supporting configuration the cleaning liquid is allowed to drain out of the casing through the casing slot before the cleaning liquid accumulates in the peripheral wall-to-roller cover spacing to the point of reaching the paint roller and, when the casing is supported in the second supporting configuration, the cleaning liquid is allowed to accumulate in the peripheral wall-to-roller cover spacing to the point of reaching the paint roller cover before reaching the casing slot and draining through the latter thus allowing at least a portion of the nap to soak in the volume of the cleaning liquid accumulated in the peripheral wall-to-roller cover spacing.

Preferably, the casing support means allows slideable movement of the nozzle outlet end in a direction generally parallel to the roller cover longitudinal axis when the casing is supported in both the first and second supporting configurations.

Conveniently, the casing support means is configured so that when the casing is supported in the first supporting configuration the casing slot is intercepted by a slot vertical geometrical plane bisecting the casing and extending perpendicularly from the supporting surface, the casing support means being also configured so that when the casing is supported in the second supporting configuration the slot second horizontal geometrical plane bisects the casing and intercepts substantially perpendicularly the slot vertical geometrical plane; whereby the casing is moved between the first and second supporting configurations by rotating the casing about the casing longitudinal axis through a casing rotational range having a value substantially in the range of ninety degrees.

Preferably, the cleaning device further comprises a turbine mounted within the casing and mechanically coupled to the roller cover support means, the nozzle tube being mounted on the casing so as to allow the nozzle outlet end to discharge the jet of the cleaning liquid selectively either along a first path lying on a chord of the paint roller cover or along a second path lying on a chord of the turbine; whereby selective positioning of the nozzle outlet end so as to discharge the jet of the cleaning liquid along the first and second paths respectively allows spin cleaning and spin drying of the paint roller cover.

Preferably, the nozzle tube is attached to a sliding block, the sliding block being slideably mounted on a guiding track extending longitudinally along the outer surface of the casing peripheral wall. Conveniently, the guiding rail includes a pair of generally "C"-shaped rail segments positioned in a facing and spaced relationship relative to each other; the sliding block defining a block-to-nozzle tube attachment section extending from a block-to-rail attachment section, the block-to-rail attachment section defining recessed peripheral sections configured and sized for being slideably retained by the rail segments.

Preferably, the block-to-nozzle tube attachment section has a nozzle tube attachment channel extending there through for slideably receiving at least a locking section of the nozzle tube, the block-to-nozzle tube attachment section also including a releasable tube locking means for releasably locking the locking section of the nozzle tube into the tube attachment section and preventing the slideable movement of the locking section of the nozzle tube relative to the nozzle tube attachment channel.

Conveniently, the releasable tube locking means includes at least one locking protrusion extending radially into the nozzle tube attachment channel and a corresponding locking recess formed on the outer surface of the block-to-nozzle tube attachment section, the at least one locking protrusion being configured and sized so as to resiliently snap into the locking recess when the locking section of the nozzle tube is slidably inserted into the nozzle tube attachment channel.

Preferably, the sliding block and the guiding track are mounted on the casing and spaced from the casing slot by an angle having a value substantially in the range of 90 degrees. Conveniently, the casing support means provides a support surface-to-peripheral wall spacing between the support surface and the outer surface of the casing peripheral wall when the casing is supported in the casing first supporting configuration.

Preferably, the nozzle tube is attached to a sliding block, the sliding block being slideably mounted on a guiding track extending longitudinally along the outer surface of the casing peripheral wall; the casing support means provides a support surface-to-peripheral wall spacing between the support surface and the outer surface of the casing peripheral wall when the casing is supported in the casing first supporting configuration; the nozzle tube extends along the outer surface of the casing peripheral wall in the support surface-to-peripheral wall spacing. Conveniently, the nozzle tube penetrates into the casing through the casing slot.

Preferably, the nozzle tube is attached to a sliding block, the sliding block being slidably mounted on a guiding track extending longitudinally along the outer surface of the casing peripheral wall, the guiding track and the casing slot being spaced relative to each other by an angle having a value substantially in the range of 90 degrees; the casing support means provides a support surface-to-peripheral wall spacing between the support surface and the outer surface of the casing peripheral wall when the casing is supported in the casing first supporting configuration; the nozzle tube extends along the outer surface of the casing peripheral wall in the support surface-to-peripheral wall spacing and penetrates into the casing through the casing slot.

Conveniently, the casing support means includes a peripheral skirt extending substantially radially and outwardly from the peripheral edge of the casing end walls so as to protrude outwardly beyond the outer surface of the casing peripheral wall, the peripheral skirt defining a first skirt abutment edge and a second skirt abutment edge for abutting against the supporting surface respectively when the casing is supported in the first and second supporting configurations.

Preferably, the first and second skirt abutment edges both have a generally rectilinear configuration and are spaced from each other by a skirt intermediate edge segment having a generally accurate configuration so that the first and second skirt abutment edges extend in a generally perpendicular relationship relative to each other.

Conveniently, at least one of the casing end walls is releasably attached to the casing peripheral wall, the at least one of the casing end walls releasably attached to the casing peripheral wall being provided with an end wall locking tongue configured, sized and positioned for axial insertion into the casing slot so as to prevent rotation of the at least one of the casing end walls releasably attached to the casing peripheral wall when the latter is attached to the casing peripheral wall.

Preferably, the roller cover support means includes a spindle shaft extending longitudinally through the casing and defining a pair of opposed shaft ends, the shaft ends being supported in corresponding shaft apertures formed in the casing end walls, at least one of the shaft ends being provided with shaft end releasable locking means for releasably preventing axial displacement of the spindle shaft relative to the casing end walls; a cylindrical supporting tube rotateably mounted on the spindle shaft, the supporting tube defining a pair of opposed supporting tube longitudinal ends and a supporting tube longitudinal axis; a pair of tube end releasable locking means for releasably preventing axial displacement of the supporting tube relative to the spindle shaft.

In accordance with another embodiment of the invention, there is provided a cleaning device for cleaning a paint roller cover with a cleaning liquid emanating from a liquid pressure supply line, the paint roller cover including a cylindrical roller tube covered with a nap, the paint roller cover defining a roller cover longitudinal axis, the cleaning device being adapted to be used on a generally horizontal supporting surface, the cleaning device comprising: a generally elongated casing for receiving the paint roller cover, the casing defining a casing longitudinal axis, a casing peripheral wall and a pair of opposed casing end walls, the casing being provided with a casing slot extending through the casing peripheral wall, the casing slot being oriented so as to extend in a direction substantially parallel to the casing longitudinal axis; a roller cover support means mounted within the casing for rotatably supporting the paint roller cover within the casing with the roller cover longitudinal axis extending in a generally parallel relationship relative to the casing longitudinal axis, the roller cover support means allowing the paint roller cover to rotate over longitudinal axis relative to the casing peripheral wall; the casing being configured and sized so as to define a peripheral wall-to-roller cover spacing between the inner surface of the casing peripheral wall and the paint roller cover; liquid discharge means attached to the casing for discharging the cleaning liquid into the casing, the liquid discharge means including a nozzle tube extending from outside the casing into the casing, the nozzle tube defining a nozzle inlet end located outside the casing and adapted to be hydraulically coupled to the liquid pressure supply line, the nozzle tube also defining a nozzle outlet end positioned inside the casing and oriented so as to discharge a jet of the cleaning liquid along a path lying on a chord of the paint roller cover, the nozzle tube being slideably mounted to the casing so as to allow slidable movement of the nozzle outlet end in a direction generally parallel to the roller cover longitudinal axis; a casing support means attached to the casing for supporting the casing on the supporting surface with the casing longitudinal axis in a generally horizontal orientation, the casing support means allowing the casing to be supported on the horizontal surface in both a first and a second supporting configuration, wherein when the casing is supported in the first supporting configuration the cleaning liquid is allowed to drain out of the casing through the casing slot before the cleaning liquid accumulates in the peripheral wall-to-roller cover spacing to the point of reaching the paint roller and, when the casing is supported in the second supporting configuration, the cleaning liquid is allowed to accumulate in the peripheral wall-to-roller cover spacing to the point of reaching the paint roller cover before reaching the casing slot and draining through the latter thus allowing at least a portion of the nap to soak in the volume of the cleaning liquid accumulated in the peripheral wall-to-roller cover spacing.

Preferably, the cleaning device further comprises a turbine mounted within the casing and mechanically coupled to the roller cover support means, the nozzle tube being mounted on the casing so as to allow the nozzle outlet end to slide longitudinally relative to the casing and to discharge the jet of the cleaning liquid along a path lying selectively on a chord of the paint roller cover or of the turbine.

In accordance with yet another embodiment of the invention, there is provided a cleaning device for cleaning a paint roller cover with a cleaning liquid emanating from a liquid pressure supply line, the paint roller cover including a cylindrical roller tube covered with a nap, the paint roller cover defining a roller cover longitudinal axis, the cleaning device being adapted to be used on a generally horizontal supporting surface, the cleaning device comprising: a generally elongated casing for receiving the paint roller cover, the casing defining a casing longitudinal axis, a casing peripheral wall and a pair of opposed casing side walls, the casing being provided with a casing slot extending through the casing peripheral wall, the casing slot being oriented so as to extend in a direction substantially parallel to the casing longitudinal axis; a roller cover support means mounted within the casing for rotatably supporting the paint roller cover within the casing with the roller cover longitudinal axis extending in a generally parallel relationship relative to the casing longitudinal axis, the roller cover support means allowing the paint roller cover to rotate about the roller cover longitudinal axis relative to the casing peripheral wall; the casing being configured and sized so as to define a peripheral wall-to-roller cover spacing between the casing peripheral wall and the paint roller cover; liquid discharge means attached to the casing for discharging the cleaning liquid into the casing, the liquid discharge means including a nozzle tube extending from outside the casing into the casing, the nozzle tube defining a nozzle inlet end located outside the casing and adapted to be hydraulically coupled to the liquid pressure supply line, the nozzle tube also defining a nozzle outlet end positioned inside the casing and oriented so as to discharge a jet of the cleaning liquid along a path lying on a chord of the paint roller cover, the nozzle tube being slidably mounted on the casing so as to allow slidable movement of the nozzle outlet end in a direction generally parallel to the roller cover longitudinal axis; a turbine mounted within the casing and mechanically coupled to the roller cover support means, the nozzle tube being mounted on the casing so as to allow the nozzle outlet end to slide longitudinally relative to the casing and to discharge the jet of the cleaning liquid along a path lying selectively on a chord of the paint roller cover or of the turbine; a casing support means attached to the casing for supporting the casing on the supporting surface with the casing longitudinal axis in a generally horizontal orientation.

BRIEF DESCRIPTION OF THE DRAWINGS

An embodiment of the present invention will now be disclosed, by way of example, in reference to the following drawings in which.

DETAILED DESCRIPTION

Figures 1, 2:
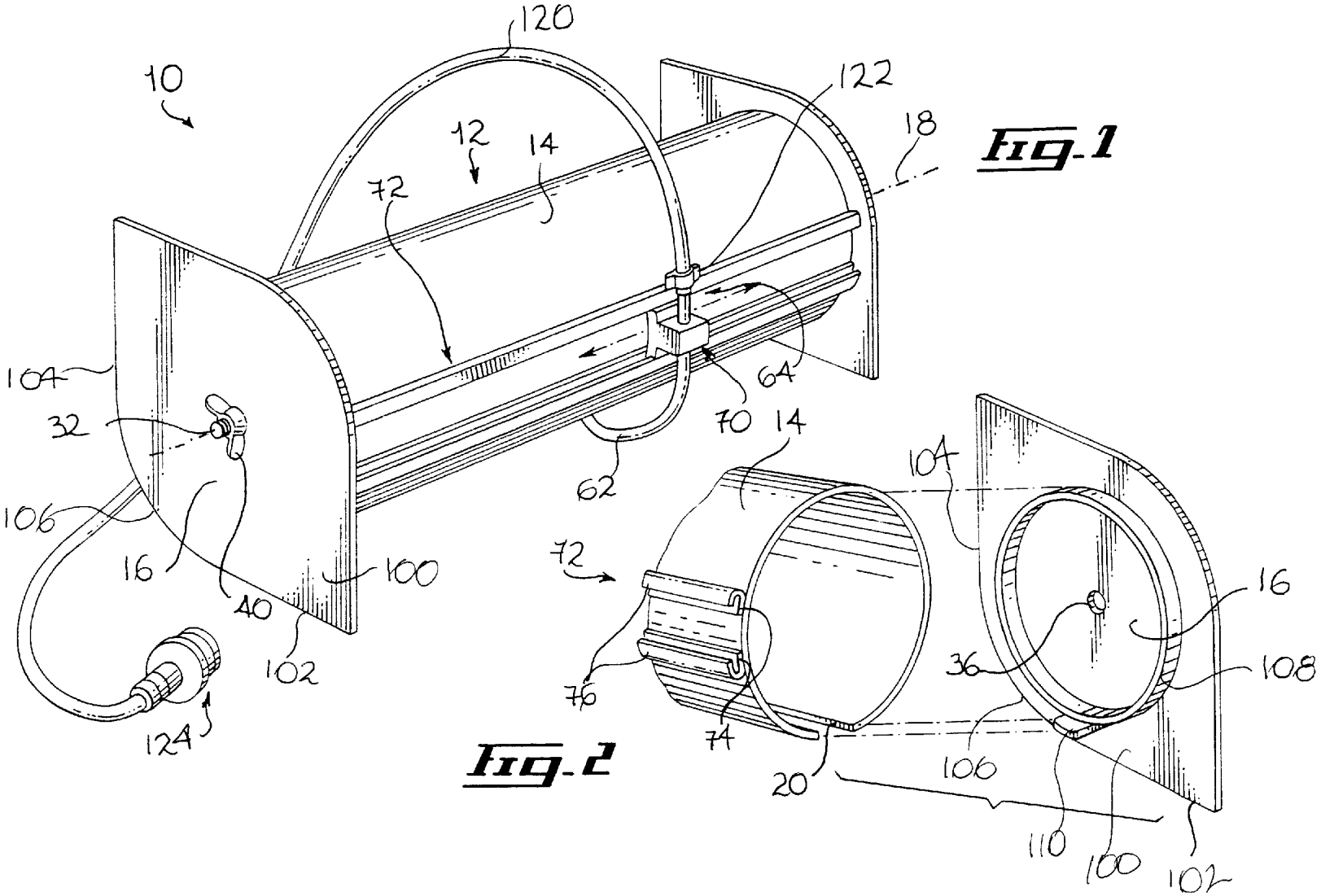
FIG. 1: in a perspective view, illustrates a paint roller cover cleaning device in accordance with an embodiment of the present invention.
FIG. 2: in a partial perspective view with sections taken out, illustrates a casing hand wall about to be assembled to a casing peripheral wall both the casing end wall and the casing peripheral wall being part of the paint roller cover cleaning device shown in FIG. 1.

Referring to FIG. 1, there is shown a paint roller cover cleaning device (10) in accordance with an embodiment of the present invention. The cleaning device (10) includes a generally elongated casing (12) for receiving a paint roller cover. The casing (12) preferably includes a generally tubular casing peripheral wall (14) and a pair of opposed casing end walls (16). The casing (12) defines a casing longitudinal axis (18). The casing (12) is provided with a casing slot (20) extending through the casing peripheral wall (14). The casing slot (20) is oriented so as to extend in the direction substantially parallel to the casing longitudinal axis (18).

Figure 3:
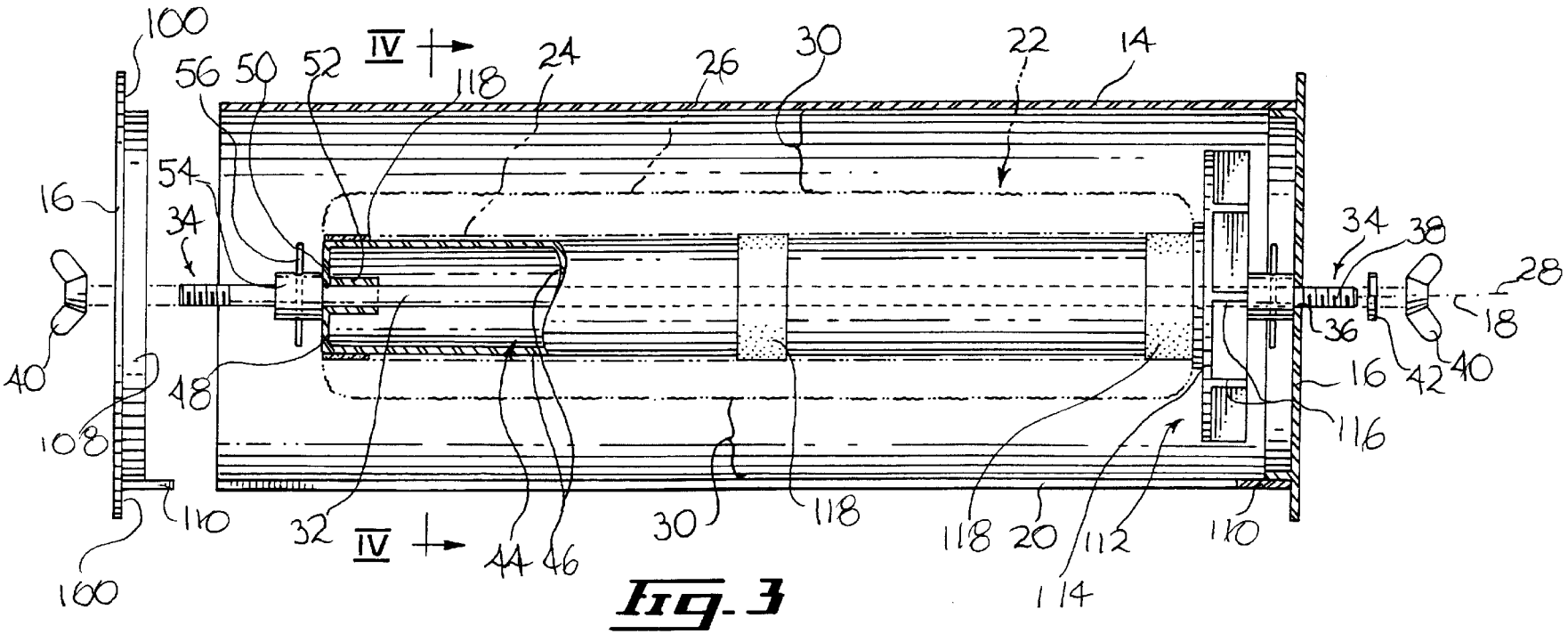
FIG. 3: in a longitudinal cross-sectional view, illustrates some of the internal components of the paint roller cover cleaning device shown in FIG. 1.

As shown more specifically in FIG. 3, the cleaning device (10) also includes a roller cover support means mounted within said casing (12) for rotatably supporting a conventional paint roller cover (22) within the casing (12). The conventional paint roller cover (12) typically includes a cylindrical roller tube (24) covered with a nap (26). The paint roller cover defines a roller cover longitudinal axis (28).

Figures 4, 5, 6, 7, 8:
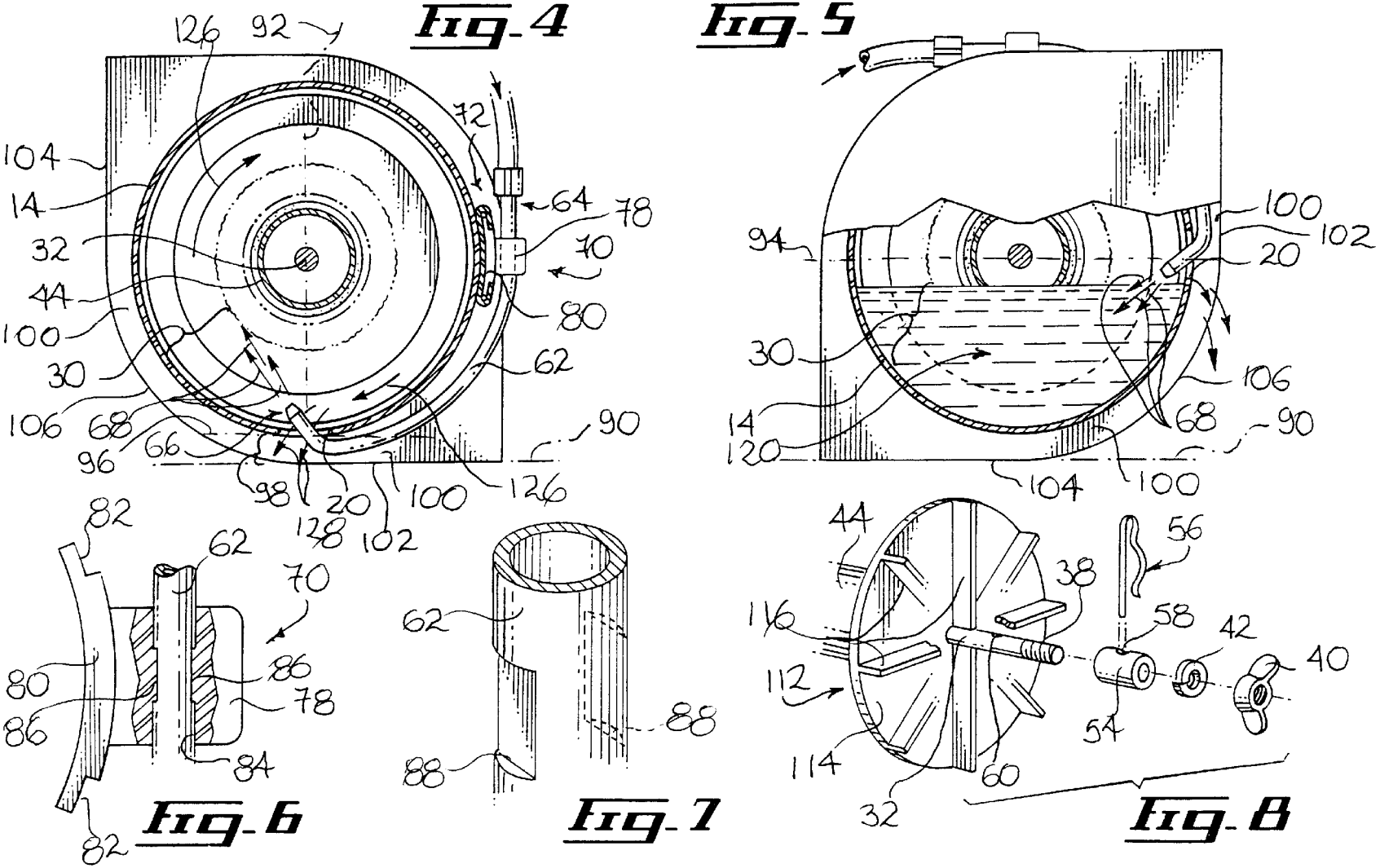
FIG. 4: in a transversal cross-sectional view, taken long arrows IV—IV of FIG. 3 illustrates some of the internal components of the paint roller cleaning device shown in FIGS. 1 through 3, the paint roller cover cleaning device being shown supported on an horizontal supporting surface and in its first supporting configuration.
FIG. 5: illustrates some of the internal components of the paint roller covercleaning device shown in FIGS. 1 through 3, the paint roller cover cleaning device being shown supported on an horizontal supporting surface and in its second supporting configuration.
FIG. 6: illustrates the connection between a nozzle tube and a sliding block both part of the paint roller cover cleaning device shown in FIGS. 1 through 5.
FIG. 7: in a detailed perspective view with section taken out, illustrates the external configuration of the nozzle tube shown in FIG. 6.
FIG. 8: in a partial perspective view illustrates some of the locking components used for mounting some of the internal components part of the paint roller cover cleaning device shown in FIGS. 1 to 7.

The roller cover support means rotatably supports the paint roller cover (22), preferably in a position so that the roller cover longitudinal axis (28) extends in a generally parallel and preferably a generally colinear-linear relationship relative to the casing longitudinal axis (18). The roller cover support means allows the paint roller cover (22) to rotate about the roller cover longitudinal axis (28) relative to the casing peripheral wall (14). As shown in FIGS. 3 through 5, the casing (12) is configured and sized so as to define a peripheral wall-to-roller cover spacing (30) between the inner surface of the casing peripheral wall (14) and the outer surface of the nap (26).

Preferably, the roller cover support means includes a spindle shaft (32) extending longitudinally through the casing (12) and defining a pair of opposed shaft ends (34). The shaft ends (34) are adapted to be journaled or supported in corresponding shaft apertures (36) formed in the casing end walls (16).

At least one and preferably both shaft ends (34) are provided with shaft end releasable locking means for releasably preventing axial displacement of the spindle shaft (32) relative to the casing end walls (16). In the embodiment of the invention shown in FIGS. 1 through 8, the shaft end releasable locking means includes an external thread (38) formed on the distal end segments of the spindle shaft (32), a wing type nut (40) and a locking washer (42) for threadably cooperating with each external thread segment (38).

The roller cover support means preferably also includes a cylindrical supporting tube (44) rotatably mounted on the spindle shaft (32). As shown more specifically in FIG. 3, the supporting tube (44) preferably defines a supporting tube peripheral wall (46) and a pair of opposed supporting tube end walls (48). The supporting tube end walls (48) are, in turn, preferably provided with shaft receiving apertures (50) having shaft mounting sleeves (52) extending inwardly from the peripheral edge thereof. The supporting tube (44) also defines a supporting tube longitudinal axis preferably extending in a substantially colinear-linear relationship relative to the roller cover longitudinal axis (28). A set of annular friction enhancing rings (118) are preferably mounted on the outer surface of the supporting tube (46). The friction enhancing rings (118) are preferably made out of a material having a generally high friction coefficient and are adapted to increase the friction coefficient between the roller tube (24) and the supporting tube (46) so as to reduce the risk of relative rotation therebetween.

In use, the paint roller cover is removed from the paint roller handle. The interior surface of the roller tube adjacent its end section is preferably wiped clean. One of the end walls (16) and associated skirt (100) is then removed using the wing nut (40). The paint roller cover (22) having paint impregnated in its nap is then slidably inserted over the supporting tube (46). The removed end wall (16) and associated skirt (100) are then placed back at their original location using the blocking tongue (110) and the flange (108) as guiding means. The wing nut (40) is used for releasably locking the end wall (16) against the corresponding longitudinal end of the peripheral wall (14).

The roller cover support means preferably further includes a pair of tube end releasably locking means for releasably preventing axial displacement of the supporting tube (44) relative to the spindle shaft (32). As illustrated more specifically in FIG. 8, each tube end releasably locking means preferably includes a locking sleeve (54) adapted to be slidably mounted on the spindle shaft (32) and to abut axially against either a supporting tube end wall (50) or another component abutting against a supporting tube end wall (50). Each locking sleeve (54) is releasably locked in a predetermined axial position relative to the spindle shaft (32), preferably using a locking clip (56) extending through both a sleeve locking aperture (58) and a shaft locking aperture (60).

The cleaning device (10) also includes a liquid discharge means attached to the casing (12) for discharging a cleaning liquid into the casing (12). Preferably, the liquid discharge means includes a nozzle tube (62) extending from outside the casing (12) into the latter. The nozzle tube (62) defines a nozzle inlet end (64) and adapted to be hydraulically coupled to a liquid pressure supply line such as a conventional faucet. The nozzle tube (62) also defines a nozzle outlet end (66) positioned inside the casing (12) and oriented so as to discharge a jet of cleaning liquid along a path lying on a chord of the paint roller cover (22). In FIGS. 4 and 5, the jet of cleaning liquid is schematically illustrated by arrows LXVIII.

In the preferred embodiment of the invention, the extension of the line of direction of the flow of the cleaning liquid coming from the outlet end (66) of the nozzle (62) will intersect a cross section of the paint roller cover (22) on a chord that is closer to a tangent than to a diameter. In the embodiment illustrated in FIGS. 4 and 5, the casing slot (20) is preferably enough larger than the diameter of the outlet end of the nozzle tube (62) so as to permit angular displacement of the nozzle outlet end (66). With this, in turn, allows variation of the direction of flow of the stream of liquid so that it can be directed against the paint roller cover (22) at a range of angles which enhances cleaning and accommodates paint roller covers (22) of various diameters. The nozzle outlet end (66) is thus preferably made of a material that is bendable and that maintains its configuration when no bending force is applied to it.

The nozzle tube (62) is slidably mounted on the casing (12) so as to allow slidable movement of the nozzle outlet end (66) in a direction generally parallel to the roller cover longitudinal axis (28). Preferably, the nozzle tube (62) is attached to a sliding block (70) slidably mounted on a guiding track (72) extending longitudinally along the outer surface of the casing peripheral wall (14).

As illustrated more specifically in FIGS. 1, 2 and 4, the guiding rail (72) typically includes a pair of generally C-shaped rail segments mounted on the exterior surface of the casing peripheral wall (14) in a facing and spaced relationship relative to each other. Each C-shaped rail segment defines a base section (74) adapted to be attached to the outer surface of the peripheral wall (14) and a hook segment (76) attached to the base segment (74). As illustrated more specifically in FIGS. 1, 4 and 6, the sliding block (70) defines a block-to-nozzle tube attachment section (78) extending from a block-to-rail attachment section (80). The block-to-rail attachment section defining recessed peripheral sections (82), configured and sized for being slidably retained between the section (74) and (76) of the rail segments forming the guiding rail (72).

The block-to-nozzle tube attachment section preferably has a nozzle tube attachment channel (84) extending therethrough for slidably receiving at least a locking section of the nozzle tube (62). The block-to-nozzle tube attachment section also includes a releasable tube locking means for releasably locking the locking section of the nozzle tube (62) into the tube attachment section and preventing the slidable movement of the locking section of the nozzle tube relative to the nozzle tube attachment channel (84).

The releasable tube locking means preferably includes at least one and preferably two locking protrusions (86) extending radially into the nozzle tube attachment channel (84) and a corresponding pair of locking recesses (88) formed on the outer surface of the block-to-nozzle tube attachment section, part of the nozzle tube (62). The locking protrusions (86) are configured and sized so as to resiliently snap into the locking recesses (88) when the locking section of the nozzle tube (62) is slidably inserted into the nozzle tube attachment channel (84). As shown more specifically in FIGS. 2, 4 and 5, the sliding block (70) and the guiding track (72) are typically mounted on the casing (12) so as to be spaced from the casing slot (20) by an angle having a value substantially in the range of 90°.

The cleaning device also includes a casing support means attached to the casing (12) for supporting the casing (12) on a generally horizontal supporting surface (90) such as the bottom wall of a sink, a table top or any other suitable supporting surface. The casing support means is adapted to support the casing (12) on the supporting surface (90) with the casing longitudinal axis (18) in a generally horizontal orientation.

The casing support means allows the casing (12) to be supported on the horizontal surface (90) in both a first supporting configuration, illustrated in FIG. 4, and a second supporting configuration, illustrated in FIG. 5. As shown in FIG. 4, when the casing (12) is supported in the first supporting configuration, the casing slot (20) is positioned in a slot first horizontal geometrical plane (96) located underneath the paint roller cover (22) in a proximal relationship relative to the support surface (90). Preferably, when the casing (12) is supported in the first supporting configuration, the casing slot (20) is intercepted by a slot vertical geometrical plane (92) bisecting the casing (12) and extending perpendicularly from the supporting surface (90).

As illustrated in FIG. 5, when the casing (12) is supported in the second supporting configuration, the casing slot (20) is positioned in a slot second horizontal geometrical plane (94) intersecting the paint roller cover (22). When the casing (12) is supported in the second supporting configuration and the casing slot (20) is spaced by 90° from the sliding block (70), the slot second horizontal geometrical plane (94) bisects the casing (22) and intercepts substantially perpendicularly the slot vertical geometrical plane (92). The casing (22) can thus be moved between the first and second supporting configurations shown in FIGS. 4 and 5 by rotating the casing (22) about the casing longitudinal axis (18) through a casing rotational range having a value substantially in the range of 90°.

The casing supporting means preferably provides a support surface-to-peripheral wall spacing (98) between the support surface (90) and the outer surface of the casing peripheral wall (14) when the casing (12) is supported in the casing first supporting configuration. The nozzle tube (62) preferably extends along the outer surface of the casing peripheral wall (14) thus allowing slidable movement of the nozzle outlet end (66) in a direction generally parallel to the roller cover longitudinal axis (28) when the casing is supported in both the first and second supporting configurations. As shown in FIGS. 4 and 5, the nozzle tube preferably extends from the sliding block (70) along the outer surface of the casing peripheral wall (14) and penetrates directly into the casing through the casing slot (20) without being obstructed by the supporting surface (90) whether in the casing first or second supporting configurations.

Preferably, the casing support means includes a peripheral skirt (100) extending substantially radially, integrally and outwardly from the peripheral edge of the casing end walls (16) so as to protrude outwardly beyond the outer surface of the casing peripheral wall (14). The peripheral skirt (100) defines a first skirt abutment edge (102) and a second skirt abutment edge (104) for abutting against the supporting surface (90) respectively when the casing (12) is supported in the first and second supporting configurations.

The first and second skirt abutment edges (102), (104) preferably both have a generally rectilinear configuration and are preferably spaced from each other by a skirt intermediate edge segment (106) having a generally arcuate configuration. The first and second skirt abutment edges (102), (104) thus extend in a generally perpendicular relationship relative to each other and are separated from each other by the skirt intermediate edge segment (106). The skirt intermediate edge segment (106) allows the casing (12) to be rolled on the supporting surface (90) between the casing first and second supporting configurations. The peripheral skirt (100) is preferably integrally prolonged about the diametrically opposed side of the end walls (16) for aesthetical and manufacturing purposes.

At least one and preferably both casing end walls (16) and their associated peripheral skirts (100) are preferably releasably attached to the casing peripheral wall (14). The casing end wall (16) and their associated peripheral skirts (100) are typically attached to the casing peripheral wall (14) using a wing nut (40) and associated locking washer (42).

As illustrated more specifically in FIGS. 2 and 3, an annular flange (108) extends inwardly from the inner surface of the end walls (16) adjacent their respective peripheral edges. The annular flange (108) is adapted to be slidably inserted within the longitudinal end sections of the casing peripheral wall (14). An end wall locking tongue (110) preferably also extends inwardly from the inner surface of at least one of the peripheral skirts (100). The end wall locking tongue (110) is configured, sized and positioned for axial insertion into the casing slots (20) so as to prevent rotation of the peripheral skirt and associated end walls (16) when the latter is attached to the casing peripheral wall (14).

A flexible hose component (120) is hydraulically coupled to the inlet end (64) of the nozzle tube (62) using a suitable hose-to-nozzle coupling component (122). The flexible hose (120) is also preferably provided with a hose-to-faucet coupling adapter (124) for hydraulically coupling the hose (122) to a suitable liquid pressure supply-line such as a conventional water faucet or the like.

As illustrated more specifically in FIGS. 3 and 8, the cleaning device (10) is preferably further provided with a turbine component (112) mounted within the casing (12) and mechanically coupled to the roller cover supporting means. The turbine component (112) typically includes a turbine disc (114) having a set of radial blades (116) extending from one of its surfaces. The turbine disc (114) is provided with a turbine disc aperture for allowing insertion of the spindle shaft (32) therethrough. The turbine component (112) is mounted on the spindle shaft (32) so as to rotate solidarily with the latter.

The nozzle tube (62) is mounted on the casing (12) so as to allow the nozzle outlet end (66) to discharge the jet of cleaning liquid (68) selectively either along a first path lying on a chord of the pain roller cover (22) or along a second path lying on a chord of the turbine component (112). Selective positioning of the nozzle outlet end (66) to as to discharge the jet of cleaning liquid along the first and second path thus respectively allowing spin cleaning and spin drying of the paint roller cover (22). The hose-to-faucet coupling adapter is then coupled to a suitable liquid pressure supply-line.

Both the vertical and angular positioning of the outlet end (66) of the nozzle tube (62) can then be optionally adjusted depending on the type and size of the paint roller cover (22) and on the texture of the paint being removed therefrom. Once the settings are adjusted, the valve allowing through flow of the cleaning liquid is opened allowing pressurized cleaning liquid to jet out of the nozzle tube outlet end (66). The of the cleaning liquid against the paint roller cover (22) causes the latter the rotate as indicated by arrows CXXVI in FIG. 4. The initial impingement of the cleaning liquid against the nap (26) causes it to penetrate deeply, preferably all the way to the cylindrical roller tube (24).

When the casing (12) is in the first casing configuration shown in FIG. 4, if the cleaning liquid impinges against the nap for a given period of time, the rate of rotation becomes eventually quite fast so that the centrifugal force causes the cleaning liquid to be thrown off the nap toward the interior surface of the casing peripheral wall (14). Eventually, the cleaning liquid mixed with the removed paint is flung off the nap by centrifugal force. As a result, there is a very effective and efficient cleansing action caused by the impinging cleaning liquid and the mixture of cleaning liquid and removed paint flows freely out from the casing slot (20) as illustrated by arrows CXXVIII.

The sliding block (70) is preferably slidably displaced along the full length of the guiding rail (72). In a preferred method of operation, the jet spray is left impinging the turbine component (112) for two to three seconds each time the sliding block (70) has completed a full back and forth cycle along the guiding rail (72). When the casing (12) is in the first supporting configuration shown in FIG. 4, the cleaning liquid is allowed to drain out of the casing through the casing slot (20) as indicated by arrows CXXVIII before the cleaning liquid accumulates in the peripheral wall-to-roller cover spacing (30) to the point of reaching the paint roller peripheral edge.

When the mixture of paint and cleaning liquid flowing out of the casing slot becomes relatively diluted, the sliding block is moved to a position opposite the turbine components (112) allowing its rotation. The casing (12) is then pivoted until it reaches the second supporting configuration illustrated in FIG. 5. When the casing (12) is supported in the second supporting configuration the cleaning liquid is allowed to accumulate in the peripheral wall-to-roller cover spacing (30) to the point of reaching the paint roller cover before reaching the casing flap (20) and draining through the latter thus allowing at least a portion of the nap (26) to soak in the volume (120) of cleaning liquid having accumulated in the peripheral wall-to-roller cover spacing (30).

Once the casing (12) is in the second supporting configuration, the sliding block (70) is moved back to the position wherein it impinges the paint roller cover (22) causing the latter to rotate. The casing (12) is then pivoted to the first supporting configuration shown in FIG. 4 allowing the volume of cleaning liquid (120) to drain out of the casing slot (20). The operation is repeated as necessary until the liquid (128) escaping from the casing slot (20) becomes clear.

Once the nap (26) is cleaned the sliding block (70) is moved back to a position wherein it directs the liquid spray (68) towards the turbine component (112). The paint roller cover (22) is spin-dried for four to five seconds or more until it becomes relatively dry. The faucet is then turned off prior to removing the paint roller cover (22) from the casing (12). The paint roller cover (22) may then be stored preferably in an upright configuration so as to not deform its outer surface. The hose-to-faucet adapter (124) is then disconnected from the faucet and the cleaning device (10) is rinsed before being left to dry. to the casing peripheral wall (14) using a wing nut (40) and associated locking washer (42).

As illustrated more specifically in FIGS. 2 and 3, an annular flange (108) extends inwardly from the inner surface of the end walls (16) adjacent their respective peripheral edges. The annular flange (108) is adapted to be slidably inserted within the longitudinal end sections of the casing peripheral wall (14). An end wall locking tongue (110) preferably also extends inwardly from the inner surface of at least one of the peripheral skirts (100). The end wall locking tongue (110) is configured, sized and positioned for axial insertion into the casing slots (20) so as to prevent rotation of the peripheral skirt and associated end walls (16) when the latter is attached to the casing peripheral wall (14).

A flexible hose component (120) is hydraulically coupled to the inlet end (64) of the nozzle tube (62) using a suitable hose-to-nozzle coupling component (122). The flexible hose (120) is also preferably provided with a hose-to-faucet coupling adapter (124) for hydraulically coupling the hose (122) to a suitable liquid pressure supply-line such as a conventional water faucet or the like.

The embodiments of the invention in which an exclusive privilege or property is claimed are defined as follows:

1. A cleaning device for cleaning a paint roller cover with a cleaning liquid emanating from a liquid pressure supply line, said paint roller cover including a cylindrical roller tube covered with a nap, said paint roller cover defining a roller cover longitudinal axis, said cleaning device being adapted to be used on a generally horizontal supporting surface, said cleaning device comprising:

a generally elongated casing for receiving said paint roller cover, said casing defining a casing longitudinal axis, a casing peripheral wall and a pair of opposed casing end walls, said casing being provided with a casing slot extending through said casing peripheral wall, said casing slot being oriented so as to extend in a direction substantially parallel to said casing longitudinal axis;

a roller cover support means mounted within said casing for rotatably supporting said paint roller cover within said casing with said roller cover longitudinal axis extending in a generally parallel relationship relative to said casing longitudinal axis, said roller cover support means allowing said paint roller cover to rotate about said roller cover longitudinal axis relative to said casing peripheral wall;

said casing being configured and sized so as to define a peripheral wall-to-roller cover spacing between the inner surface of said casing peripheral wall and said paint roller cover;

liquid discharge means attached to said casing for discharging said cleaning liquid into said casing, said liquid discharge means including a nozzle tube extending from outside said casing into said casing, said nozzle tube defining a nozzle inlet end located outside said casing and adapted to be hydraulically coupled to said liquid pressure supply line, said nozzle tube also defining a nozzle outlet end positioned inside said casing and oriented so as to discharge a jet of said cleaning liquid along a path lying on a chord of said paint roller cover, said nozzle tube being slidably mounted to said casing so as to allow slidable movement of said nozzle outlet end in a direction generally parallel to said roller cover longitudinal axis;

a casing support means attached to said casing for supporting said casing on said supporting surface with said casing longitudinal axis in a generally horizontal orientation, said casing support means allowing said casing to be supported on said horizontal surface in both a first and a second supporting configuration, wherein when said casing is supported in said first supporting configuration said casing slot is positioned in a slot first horizontal geometrical plane located underneath said paint roller cover in a proximal relationship relative to said support surface and wherein when said casing is supported in said second supporting configuration said casing slot is positioned in a slot second horizontal geometrical plane intersecting said paint roller cover;

whereby when said casing is supported in said first supporting configuration said cleaning liquid is allowed to drain out of said casing through said casing slot before said cleaning liquid accumulates in said peripheral wall-to-roller cover spacing to the point of reaching said paint roller and, when said casing is supported in said second supporting configuration, said cleaning liquid is allowed to accumulate in said peripheral wall-to-roller cover spacing to the point of reaching said paint roller cover before reaching said casing slot and draining through the latter thus allowing at least a portion of said nap to soak in the volume of said cleaning liquid accumulated in said peripheral wall-to-roller cover spacing.

2. A cleaning device as recited in claim 1 wherein said casing support means allows slidable movement of said nozzle outlet end in a direction generally parallel to said roller cover longitudinal axis when said casing is supported in both said first and second supporting configurations.

3. A cleaning device as recited in claim 1 wherein said casing support means is configured so that when said casing is supported in said first supporting configuration said casing slot is intercepted by a slot vertical geometrical plane bisecting said casing and extending perpendicularly from said supporting surface, said casing support means being also configured so that when said casing is supported in said second supporting configuration said slot second horizontal geometrical plane bisects said casing and intercepts substantially perpendicularly said slot vertical geometrical plane; whereby said casing is moved between said first and second supporting configurations by rotating said casing about said casing longitudinal axis through a casing rotational range having a value substantially in the range of ninety degrees.

4. A cleaning device as recited in claim 1 further comprising a turbine mounted within said casing and mechanically coupled to said roller cover support means, said nozzle tube being mounted on said casing so as to allow said nozzle outlet end to discharge said jet of said cleaning liquid selectively either along a first path lying on a chord of said paint roller cover or along a second path lying on a chord of said turbine; whereby selective positioning of said nozzle outlet end so as to discharge said jet of said cleaning liquid along said first and second paths respectively allows spin cleaning and spin drying of said paint roller cover.

5. A cleaning device as recited in claim 1 wherein said nozzle tube is attached to a sliding block, said sliding block being slidably mounted on a guiding track extending longitudinally along the outer surface of said casing peripheral wall.

6. A cleaning device as recited in claim 5 wherein said guiding rail includes a pair of generally "C"-shaped rail segments positioned in a facing and spaced relationship relative to each other; said sliding block defining a block-to-nozzle tube attachment section extending from a block-to-rail attachment section, said block-to-rail attachment section defining recessed peripheral sections configured and sized for being slidably retained by said rail segments.

7. A cleaning device as recited in claim 6 wherein said block-to-nozzle tube attachment section has a nozzle tube attachment channel extending therethrough for slidably receiving at least a locking section of said nozzle tube, said block-to-nozzle tube attachment section also including a releasable tube locking means for releasably locking said locking section of said nozzle tube into said tube attachment section and preventing the slidable movement of said locking section of said nozzle tube relative to said nozzle tube attachment channel.

8. A cleaning device as recited in claim 6 wherein said releasable tube locking means includes at least one locking protrusion extending radially into said nozzle tube attachment channel and a corresponding locking recess formed on the outer surface of said block-to-nozzle tube attachment section, said at least one locking protrusion being configured and sized so as to resiliently snap into said locking recess when said locking section of said nozzle tube is slidably inserted into said nozzle tube attachment channel.

9. A cleaning device as recited in claim 5 wherein said sliding block and said guiding track are mounted on said casing and spaced from said casing slot by an angle having a value substantially in the range of 90 degrees.

10. A cleaning device as recited in claim 1 wherein said casing support means provides a support surface-to-peripheral wall spacing between said support surface and the outer surface of said casing peripheral wall when said casing is supported in said casing first supporting configuration.

11. A cleaning device as recited in claim 1 wherein said nozzle tube is attached to a sliding block, said sliding block being slidably mounted on a guiding track extending longitudinally along the outer surface of said casing peripheral wall;

said casing support means provides a support surface-to-peripheral wall spacing between said support surface and the outer surface of said casing peripheral wall when said casing is supported in said casing first supporting configuration;

said nozzle tube extends along the outer surface of said casing peripheral wall in said support surface-to-peripheral wall spacing.

12. A cleaning device as recited in claim 1 wherein said nozzle tube penetrates into said casing through said casing slot.

13. A cleaning device as recited in claim 1 wherein said nozzle tube is attached to a sliding block, said sliding block being slidably mounted on a guiding track extending longitudinally along the outer surface of said casing peripheral wall, said guiding track and said casing slot being spaced relative to each other by an angle having a value substantially in the range of 90 degrees;

said casing support means provides a support surface-to-peripheral wall spacing between said support surface and the outer surface of said casing peripheral wall when said casing is supported in said casing first supporting configuration;

said nozzle tube extends along the outer surface of said casing peripheral wall in said support surface-to-peripheral wall spacing and penetrates into said casing through said casing slot.

14. A cleaning device as recited in claim 1 wherein said casing support means includes a peripheral skirt extending substantially radially and outwardly from the peripheral edge of said casing end walls so as to protrude outwardly beyond the outer surface of said casing peripheral wall, said peripheral skirt defining a first skirt abutment edge and a second skirt abutment edge for abutting against said supporting surface respectively when said casing is supported in said first and second supporting configurations.

15. A cleaning device as recited in claim 14 wherein said first and second skirt abutment edges both have a generally rectilinear configuration and are spaced from each other by a skirt intermediate edge segment having a generally arcuate configuration so that said first and second skirt abutment edges extend in a generally perpendicular relationship relative to each other.

16. A cleaning device as recited in claim 15 wherein at least one of said casing end walls is releasably attached to said casing peripheral wall, said at least one of said casing end walls releasably attached to said casing peripheral wall being provided with an end wall locking tongue configured, sized and positioned for axial insertion into said casing slot so as to prevent rotation of said at least one of said casing end walls releasably attached to said casing peripheral wall when the latter is attached to said casing peripheral wall.

17. A cleaning device as recited in claim 1 wherein said roller cover support means includes a spindle shaft extending longitudinally through said casing and defining a pair of opposed shaft ends, said shaft ends being supported in corresponding shaft apertures formed in said casing end walls, at least one of said shaft ends being provided with shaft end releasable locking means for releasably preventing axial displacement of said spindle shaft relative to said casing end walls;

a cylindrical supporting tube rotatably mounted on said spindle shaft, said supporting tube defining a pair of opposed supporting tube longitudinal ends and a supporting tube longitudinal axis;

a pair of tube end releasable locking means for releasably preventing axial displacement of said supporting tube relative to said spindle shaft.

18. A cleaning device for cleaning a paint roller cover with a cleaning liquid emanating from a liquid pressure supply line, said paint roller cover including a cylindrical roller tube covered with a nap, said paint roller cover defining a roller cover longitudinal axis, said cleaning device being adapted to be used on a generally horizontal supporting surface, said cleaning device comprising:

a generally elongated casing for receiving said paint roller cover, said casing defining a casing longitudinal axis, a casing peripheral wall and a pair of opposed casing end walls, said casing being provided with a casing slot extending through said casing peripheral wall, said casing slot being oriented so as to extend in a direction substantially parallel to said casing longitudinal axis;

a roller cover support means mounted within said casing for rotatably supporting said paint roller cover within said casing with said roller cover longitudinal axis extending in a generally parallel relationship relative to said casing longitudinal axis, said roller cover support means allowing said paint roller cover to rotate about said roller cover longitudinal axis relative to said casing peripheral wall;

said casing being configured and sized so as to define a peripheral wall-to-roller cover spacing between the inner surface of said casing peripheral wall and said paint roller cover;

liquid discharge means attached to said casing for discharging said cleaning liquid into said casing, said liquid discharge means including a nozzle tube extending from outside said casing into said casing, said nozzle tube defining a nozzle inlet end located outside said casing and adapted to be hydraulically coupled to said liquid pressure supply line, said nozzle tube also defining a nozzle outlet end positioned inside said casing and oriented so as to discharge a jet of said cleaning liquid along a path lying on a chord of said paint roller cover, said nozzle tube being slidably mounted to said casing so as to allow slidable movement of said nozzle outlet end in a direction generally parallel to said roller cover longitudinal axis;

a casing support means attached to said casing for supporting said casing on said supporting surface with said casing longitudinal axis in a generally horizontal orientation, said casing support means allowing said casing to be supported on said horizontal surface in both a first and a second supporting configuration, wherein when said casing is supported in said first supporting configuration said cleaning liquid is allowed to drain out of said casing through said casing slot before said cleaning liquid accumulates in said peripheral wall-to-roller cover spacing to the point of reaching said paint roller and, when said casing is supported in said second supporting configuration, said cleaning liquid is allowed to accumulate in said peripheral wall-to-roller cover spacing to the point of reaching said paint roller cover before reaching said casing slot and draining through the latter thus allowing at least a portion of said nap to soak in the volume of said cleaning liquid accumulated in said peripheral wall-to-roller cover spacing.

19. A cleaning device as recited in claim 18 further comprising a turbine mounted within said casing and mechanically coupled to said roller cover support means, said nozzle tube being mounted on said casing so as to allow said nozzle outlet end to slide longitudinally relative to said casing and to discharge said jet of said cleaning liquid along a path lying selectively on a chord of said paint roller cover or of said turbine.

20. A cleaning device for cleaning a paint roller cover with a cleaning liquid emanating from a liquid pressure supply line, said paint roller cover including a cylindrical roller tube covered with a nap, said paint roller cover defining a roller cover longitudinal axis, said cleaning device being adapted to be used on a generally horizontal supporting surface, said cleaning device comprising:

a generally elongated casing for receiving said paint roller cover, said casing defining a casing longitudinal axis, a casing peripheral wall and a pair of opposed casing side walls, said casing being provided with a casing slot extending through said casing peripheral wall, said casing slot being oriented so as to extend in a direction substantially parallel to said casing longitudinal axis;

a roller cover support means mounted within said casing for rotatably supporting said paint roller cover within said casing with said roller cover longitudinal axis extending in a generally parallel relationship relative to said casing longitudinal axis, said roller cover support means allowing said paint roller cover to rotate about said roller cover longitudinal axis relative to said casing peripheral wall;

said casing being configured and sized so as to define a peripheral wall-to-roller cover spacing between said casing peripheral wall and said paint roller cover;

liquid discharge means attached to said casing for discharging said cleaning liquid into said casing, said liquid discharge means including a nozzle tube extending from outside said casing into said casing, said nozzle tube defining a nozzle inlet end located outside said casing and adapted to be hydraulically coupled to said liquid pressure supply line, said nozzle tube also defining a nozzle outlet end positioned inside said casing and oriented so as to discharge a jet of said cleaning liquid along a path lying on a chord of said paint roller cover, said nozzle tube being slidably mounted on said casing so as to allow slidable movement of said nozzle outlet end in a direction generally parallel to said roller cover longitudinal axis;

a turbine mounted within said casing and mechanically coupled to said roller cover support means, said nozzle tube being mounted on said casing so as to allow said nozzle outlet end to slide longitudinally relative to said casing and to discharge said jet of said cleaning liquid along a path lying selectively on a chord of said paint roller cover or of said turbine;

a casing support means attached to said casing for supporting said casing on said supporting surface with said casing longitudinal axis in a generally horizontal orientation.

* * * * *